US005718116A

United States Patent [19]

Grassi et al.

[11] Patent Number: 5,718,116

[45] Date of Patent: Feb. 17, 1998

[54] OPEN LOOP, AIR REFRIGERANT, HEAT PUMP PROCESS FOR REFRIGERATING AN ENCLOSED SPACE

[75] Inventors: Kimberly Schroeder Grassi, Schnecksville; Robert Jon Shaw, Allentown; Joseph Perry Cohen, Bethlehem, all of Pa.

[73] Assignee: Air Products and Chemicals, Inc., Allentown, Pa.

[21] Appl. No.: 746,511

[22] Filed: Nov. 12, 1996

[51] Int. Cl.[6] ..... F25D 25/00

[52] U.S. Cl. ..... 62/62; 62/86; 62/402

[58] Field of Search ..... 62/62, 86, 402, 62/93

[56] References Cited

U.S. PATENT DOCUMENTS 5,267,449 12/1993 Kiczek et al. ..... 62/86

*Primary Examiner*—Henry A. Bennett

*Assistant Examiner*—Pamela A. O'Connor

*Attorney, Agent, or Firm*—Robert J. Wolff

[57] ABSTRACT

An open loop, air refrigerant heat pump process is set forth for producing a refrigerated atmosphere inside an enclosed space, in particular the enclosed space of a food freezer. A key to the present invention is that it uses a portion of the cold expander discharge to cool the air feed to the expander, prior to using said portion as a regeneration gas for the front end, adsorbent-containing drier. This is key because it allows one to eliminate the prior art's need to recover refrigeration from the air exiting the enclosed space which, more importantly, allows one to eliminate the prior art need to remove any cryogenically generated ice that the air picks up inside the food freezer.

4 Claims, 2 Drawing Sheets

OPEN LOOP, AIR REFRIGERANT, HEAT PUMP PROCESS FOR REFRIGERATING AN ENCLOSED SPACE

BACKGROUND OF THE INVENTION

An open loop, air refrigerant, heat pump process for producing a refrigerated atmosphere inside an enclosed space is taught in the art. Specifically, U.S. Pat. No. 5,267,449 by Kiczek et al (hereinafter Kiczek) teaches such a process as depicted in FIG. 1. Referring now to FIG. 1, ambient air in stream 10 is filtered to remove solid particulates in a particulate filter PF1; compressed to an elevated pressure in a compressor C1; cooled to approximately ambient temperature in a first heat exchanger HX1; dried and cleaned of gaseous contaminants (typically in an adsorbent-containing drier system D1); further cooled to a temperature below −17.8° C. (0° F.) in a second heat exchanger HX2; expanded to ambient pressure and a cryogenic temperature in an expander E1; and finally used as a direct contact refrigerant in stream 20 for a food freezer FF1.

A challenge in Kiczek is that following the removal of the air refrigerant from the freezer in stream 30 and prior to recovering its remaining refrigeration in heat exchanger HX2 against incoming air, stream 30 must be cleaned of cryogenically generated ice particles that the air refrigerant picks up inside the freezer. This would typically be done with a continuous ice filtration and removal system as represented by IF1 in FIG. 1. (If the ice were not removed, stream 30 would foul heat exchanger HX2 and would also be unsuitable as a source of the regeneration gas for the adsorbent-containing drier system D1 as represented by stream 40 in FIG. 1.)

Unfortunately, the cost of a continuous ice and filtration system can be prohibitive within the context of FIG. 1's process. Accordingly, it is one object of the present invention to modify Kiczek to eliminate the need for such a system.

BRIEF SUMMARY OF THE INVENTION

The present invention is an open loop, air refrigerant, heat pump process for producing a refrigerated atmosphere inside an enclosed space, in particular the enclosed space of a food freezer. A key to the present invention is that it uses a portion of the cold expander discharge to cool the air feed to the expander, prior to using said portion as a regeneration gas for the front end, adsorbent-containing drier. This is key because it allows one to eliminate the prior art's need to recover refrigeration from the air exiting the enclosed space which, more importantly, allows one to eliminate the prior art need to remove any cryogenically generated ice that the air picks up inside the food freezer.

DETAILED DESCRIPTION OF THE INVENTION

Figure 2:
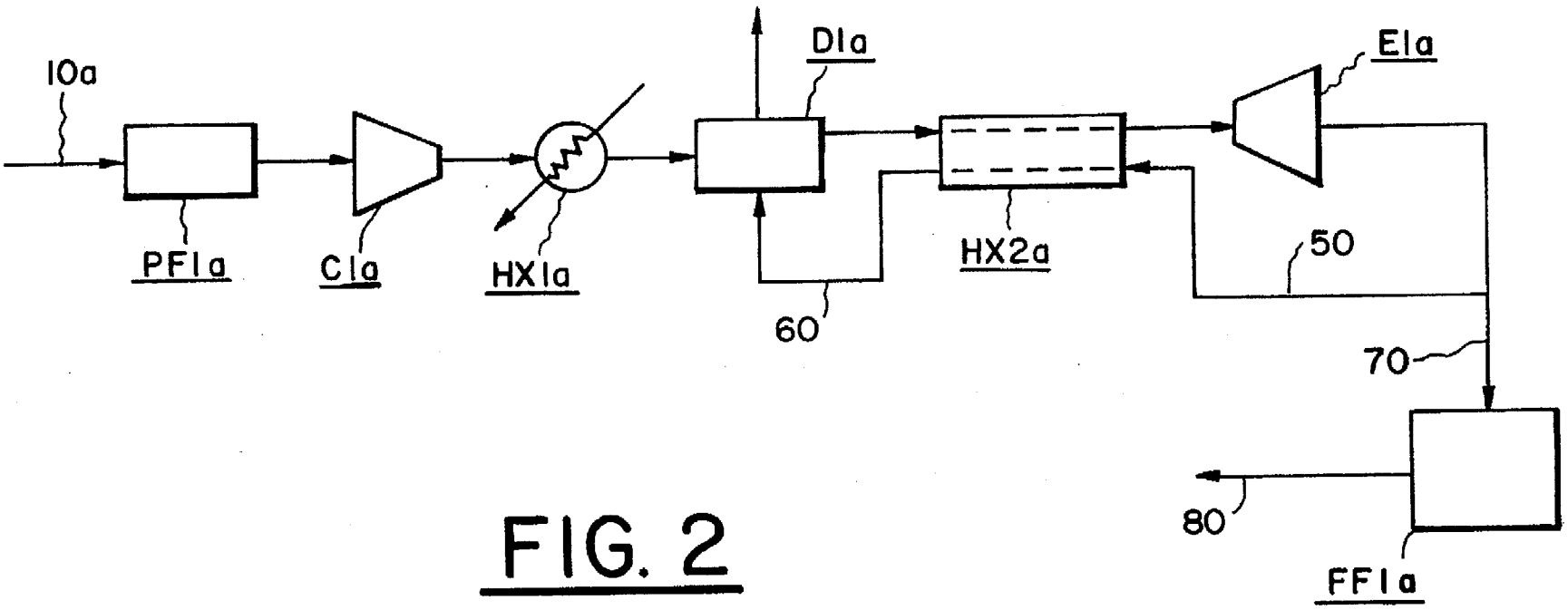
FIG. 2 is a schematic diagram of one embodiment of the present invention's open loop, air refrigerant heat pump process for producing a refrigerated atmosphere inside an enclosed space.

The process of the present invention is best illustrated with respect to a specific embodiment thereof such as FIG. 2's embodiment. Referring now to FIG. 2, FIG. 2's embodiment comprises:

(a) filtering an ambient air stream 10*a* to remove solid particulates in a particulate filter PF1*a* and subsequently compressing the air stream to an elevated pressure between approximately 100 and 600 psig (typically around 200 psig) in compressor C1*a;*

(b) cooling the air stream to approximately ambient temperature by indirect heat exchange against cooling water in a first heat exchanger HX1*a;*

(c) removing moisture and gaseous contaminants from the air stream in an adsorbent-containing drier system D1*a;*

(d) further cooling the air stream to approximately −1° C. (30° F.) by indirect heat exchange in a second heat exchanger HX2*a*;

(e) expanding the air stream to a cryogenic temperature of approximately −110° C. (−166° F.) and a pressure slightly above atmospheric in an expander E1*a* (although not shown in FIG. 2, this expander and step (a)'s compressor C1*a* can be advantageously linked as a compander);

(f) warming a portion (typically 20–30% as represented by stream 50 in FIG. 2) of the air stream to approximately ambient temperature by indirect heat exchange in the second heat exchanger HX2*a* against the air stream undergoing step (d)'s further cooling step thereby providing the refrigeration to accomplish step (d)'s further cooling step, and subsequently using said portion as a regeneration gas (stream 60 in FIG. 2) for the adsorbent-containing drier system;

(g) warming the remaining portion of the air stream (stream 70 in FIG. 2) to approximately −46° C. (−51° F.) by direct heat exchange against the inside of a food freezer FF1*a,* thereby producing said refrigerated atmosphere inside the food freezer; and (h) removing the remaining portion of the air stream (stream 80 in FIG. 2) from the food freezer.

Figure 1:
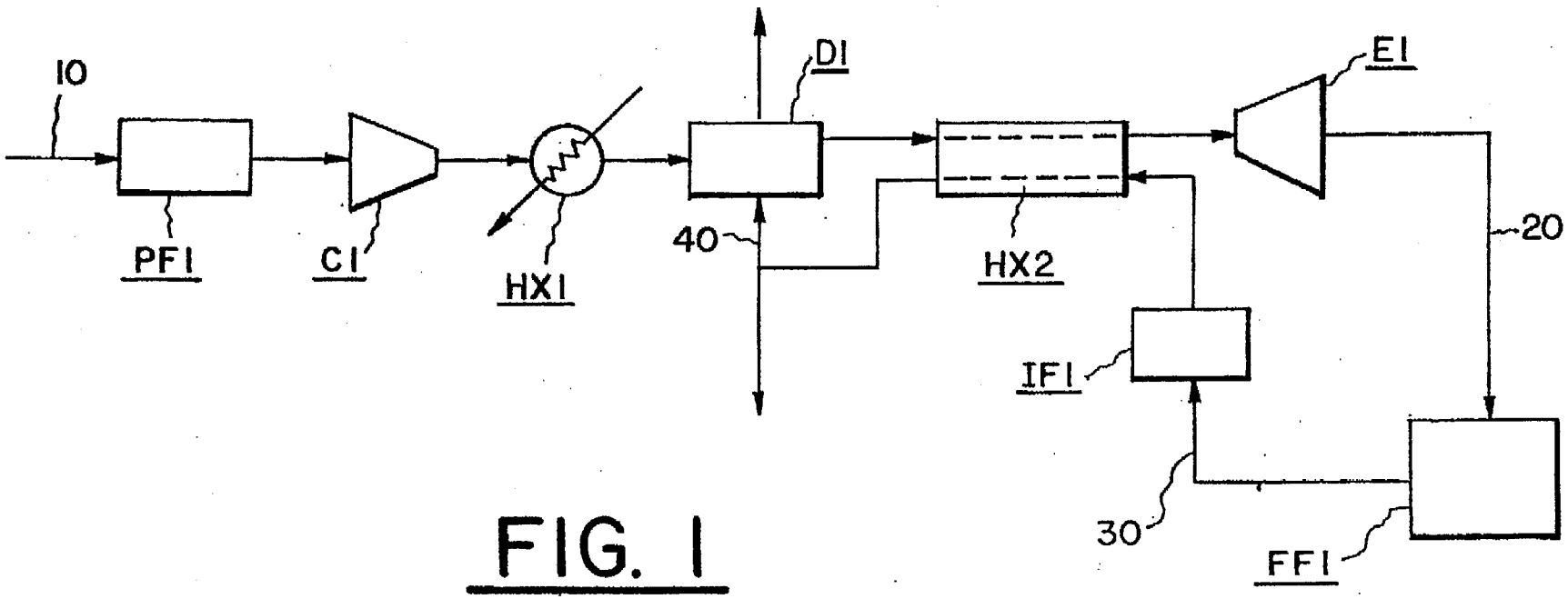
FIG. 1 PRIOR ART
FIG. 1 is a schematic diagram of the prior art open loop, air refrigerant heat pump process for producing a refrigerated atmosphere inside an enclosed space.

Distinguishing FIG. 2's embodiment of the present invention's process from FIG. 1's prior art process, FIG. 1 uses the entire portion of the cold expander discharge (stream 20) to cool the enclosed space while FIG. 2 divides the expander discharge between a portion (stream 50) to cool the air feed to the expander and a portion (stream 70) to cool the enclosed space. By using some of the expander discharge to cool the expander feed, a colder expander discharge temperature is realized for a given expander feed pressure. This efficiency advantage substantially offsets the efficiency penalty that can be expected from the fact that FIG. 1 recovers the remaining refrigeration from its air refrigerant stream exiting the enclosed space while FIG. 2 does not. More importantly, this efficiency penalty is also offset by a key operational advantage. By not recovering the remaining refrigeration from the air refrigerant stream exiting the freezer, FIG. 2 eliminates the need for FIG. 1's continuous ice filtration and removal system as represented by IF1 in FIG. 1.

The skilled practitioner will appreciate that there are many other embodiments of the present invention which are within the scope of the following claims.

We claim:

1. An open loop, air refrigerant, heat pump process for producing a refrigerated atmosphere inside an enclosed space comprising the steps of:

(a) compressing an ambient air stream to an elevated pressure;

(b) cooling the air stream to approximately ambient temperature;

(c) removing moisture and gaseous contaminants from the air stream in an adsorbent-containing drier system;

(d) further cooling the air stream;

(e) expanding the air stream to a cryogenic temperature and a pressure slightly above atmospheric;

(f) warming a portion of the air stream to approximately ambient temperature by indirect heat exchange against the air stream undergoing step (d)'s further cooling step, thereby providing the refrigeration to accomplish step (d)'s further cooling step, and subsequently using said portion as a regeneration gas for the adsorbent-containing drier system in step (c);

(g) warming the remaining portion of the air stream by direct heat exchange against the inside of the enclosed space, thereby producing said refrigerated atmosphere inside the enclosed space; and (h) removing the remaining portion of the air stream from the enclosed space.

2. The process of claim 1 wherein the enclosed space is the inside of a food freezer.

3. The process of claim 2 wherein:

(i) prior to compressing the air stream in step (a), the air stream is filtered to remove solid particulates in a particulate filter;

(ii) in step (a), the air stream is compressed to an elevated pressure of approximately 200 psig;

(iii) in step (b), the air stream is cooled to approximately ambient temperature by indirect heat exchange against cooling water in a first heat exchanger;

(iv) in step (d), the air stream is further cooled to approximately −1° C. (30° F.) by indirect heat exchange against said portion of the air stream form step (f) in a second heat exchanger;

(v) in step (e), the air stream is expanded to a cryogenic temperature of approximately −110° C. (−166° F.)and a pressure slightly above atmospheric in an expander;

(vi) in step (f), the portion of the air stream that is warmed constitutes 20–30% of the air stream; and (vii) in step (g), the remaining portion of the air stream is warmed to approximately −46° C. (−51° F.) by direct heat exchange against the inside of the enclosed space.

4. The process of claim 3 wherein the compressor in step (a) and the expander in step (e) are linked as a compander unit.

* * * * *